US009915072B1

(12) United States Patent
Platts et al.

(10) Patent No.: US 9,915,072 B1
(45) Date of Patent: Mar. 13, 2018

(54) QUIET-ACTING VALVED VENT

(71) Applicants: Robert E. Platts, Ottawa (CA); Peter A. G. Russell, Ottawa (CA)

(72) Inventors: Robert E. Platts, Ottawa (CA); Peter A. G. Russell, Ottawa (CA)

( * ) Notice: Subject to any disclaimer, the term of this patent is extended or adjusted under 35 U.S.C. 154(b) by 0 days.

(21) Appl. No.: 14/645,421

(22) Filed: Mar. 12, 2015

(51) Int. Cl.
*E04D 13/17* (2006.01)

(52) U.S. Cl.
CPC ..... *E04D 13/178* (2013.01)

(58) Field of Classification Search
CPC ..... F24F 7/02; F24F 2221/52; E04D 13/17; E04D 13/152; E04D 2001/309; E04D 13/178; E04F 13/007
USPC ..... 52/95, 198, 302.1, 302.3, 302.7; 454/242, 250, 358, 364, 365, 366
See application file for complete search history.

(56) References Cited

U.S. PATENT DOCUMENTS 2,188,699 A * 1/1940 Barron ..... F24F 7/02 454/20
3,410,194 A * 11/1968 Reusch ..... F24F 7/02 454/364
4,567,816 A * 2/1986 Kolt ..... F24F 13/1426 137/512.15
5,983,971 A * 11/1999 Miller ..... E06B 9/0638 160/170
6,484,459 B1 * 11/2002 Platts ..... E04H 9/14 52/202
6,491,579 B1 * 12/2002 O'Hagin ..... E04D 1/30 454/250
7,127,855 B1 * 10/2006 Garvey ..... E04D 13/0354 52/1
7,984,592 B1 * 7/2011 Jiras ..... A01F 25/163 52/192
2007/0072541 A1 * 3/2007 Daniels, II ..... F24F 7/02 454/365
2013/0074428 A1 * 3/2013 Allen ..... E04D 13/17 52/173.3
2015/0197955 A1 * 7/2015 Platts ..... E04B 1/92 52/235

* cited by examiner

*Primary Examiner* — Brent W Herring

(57) ABSTRACT

An airflow-controlling valve is described for a soffit vent in which a one-piece valve member normally lies below a housing, both parts being deeply hill-and-valley deformed to give ample surface area for apertures essentially equal to the full area of the vent opening itself, allowing two-way venting flow unless and until inward-acting pressure reaches a certain strength, wherewith the valve is pushed up to close quietly against the housing to block flow; the valve falling opening again if the pressure differential reverses or simply subsides below that certain strength. An immediate need for the device is in ventilating houses and like building structures, and in particular in ventilating roof spaces such as attics to make the structures much more resistant to hurricane damage firstly by blocking ruinous rain entry while also "harnessing" the winds to prevent roof space pressurization, or even (given other openings are valved or closed off) to strongly depressurize the roof space by preventing inward airflow but allowing outward flow to wind-depressurized zones bounding the house.

6 Claims, 3 Drawing Sheets

QUIET-ACTING VALVED VENT

TECHNICAL FIELD

The present invention relates to an airflow controlling valved vent, particularly for controlling naturally induced airflow in and out of attics and other roof spaces through ventilation openings.

BACKGROUND OF THE INVENTION

Soffit vents help assure attic ventilation, reducing moisture and heat problems—but they tend to worsen the destructive action of hurricane-force winds. Rain can be wind-borne through the vents into the attic or such roof space, causing ruinous mould and even ceiling collapse, and in common house configurations the soffit vents can allow roof space pressurization that increases the net outward pressure that can blow apart the roof envelope.

If soffit vents are valved, however, their role in hurricane winds can be changed from harmful to helpful. In U.S. Pat. No. 6,484,459 B1, "Counter-Pressure Method and Apparatus for Protecting Roofs against Hurricanes", Platts discloses how valving soffit vents can not only prevent roof space pressurization in strong winds but can ensure wind-induced depressurization therein, which "counter-pressures" the wind's "suction" above and around the roof, thereby reducing the net outward pressures on the roof envelope and so helping keep it all intact—roof sheathing down, gables on, soffit and ceiling up. The depressurizing action is simple and strong (given that gross air leaks are sealed and other roof vents are closed off or are themselves valved); while the valves in windward soffit vents blow closed in strong winds, the soffit vents around the wind-depressurized lee sides of the house remain open, leaving the roof space connected only to the lee side air and so itself depressurized.

In the referenced patent, Platts scarcely touches upon the valve design issue. A "hanging flap" valve for soffit vents is sketched therein, simply to help illustrate the depressurization idea; such a normally-open valve hanging below a soffit would be prone to "missile" damage in hurricanes and would be objectionably noisy in gusty winds. The noise problem dogged all designs, starting with an above-soffit single-flap valve developed for the first lab and field trials of Platts' counter-pressure idea. Foam rubber dampers failed to muffle the hinged flap's "whumph" noise in gusty winds. (The householders therefore chose to lock the valves open, thus requiring their presence at home to unlock them if a storm threatened—losing their "always ready" advantage.)

Accordingly, to reduce the flap mass and hence the noise problem, and also to reduce height so the valved vents could fit into shallow soffit spaces, common multi-flap "vent cap" valve products were adapted for further valved-vent lab and field trials. The small flaps must still be fairly substantial, however, since they span beam-like across the opening, pin-hinge-supported only at their ends. Further, they're still hinged flaps, with their free sides swinging fast and closing against small areas, so they still operate noisily. And airflow under and through such louver-type flaps tends to set up "flutter": their sounds simply become a higher-pitched "flap" or "rat-a-tat" clatter, again calling for fussy insertion of resilient felt or foam dampers—which still prove rather ineffective.

More problems: Most ways of valving a vent tend to restrict flow, the open area becoming considerably less than the vent's overall plan area. So a required venting area must use bigger vents or more of them, adding more cost of parts and installation. (Primary example: building codes commonly require a total "net free area" for roof space ventilation. While common insect screens block 50% of an opening's area, 70%-open screens have been developed for roof space vent grilles to help provide such net free area more economically.) Valve responsiveness is of concern too: reliable and speedy closure are important but not readily assured with multi-flap designs.

Looking further into the prior art of fluid flow control valves, the main examples are as old as plant and animal life, where nature offers the original and marvelous flap, gill, tongue, throat, diaphragm and even ball valves. Man adapted these and added more, including butterfly, reed, rotary, slide or sleeve, needle and poppet-orifice valves, meeting a very wide range of flow-control needs.

Gally, in U.S. Pat. No. 1,271,562, AIR PUMPER CHECK, Jul. 9, 1918, invented a quiet, relatively free-flow "V" 2-flap check valve (for Baldwin player pianos) that's not, however, readily adaptable to a normally-open stance offering two-way unimpeded flow.

In U.S. Pat. No. 3,895,646, Jul. 22 1975, SELF REGULATING VANE TYPE VALVE FOR CONTROLLING AIR FLOW, Howat describes a quiet-acting building ventilation control valve offering flow modulation passively adjusted by temperature and/or air pressure differentials, say, using bi-metallic or simply springy "V" shaped vanes arranged in a cone fashion. It's not intrinsically good for two-way ventilation, being relatively flow-restrictive even if made to stand somewhat open for normal two-way ventilation.

Foley, in U.S. Pat. No. 5,842,503, Dec. 1, 1998, INTEGRALLY FORMED AIR FLOW VALVE, describes a light, quiet and inexpensive valve expressly for one-way relief of door-slamming pressure effects in automobiles. It offers a series of V valves that could well fit the spatial and structural requirements of soffit vents for roof spaces, with the V's somewhat modifiable to allow two-way flow, but again with excessive impedance to venting flows so that the valve would have to be very large to provide a given flow path.

Another simple, quiet valve is presented by Bowers et al., in U.S. Pat. No. 7,448,219 B2 Nov. 11, 2008, HINGELESS FLAPPER VALVE FOR FLOW CONTROL. The self-hinging, self-actuating valve (very much like a tongue housed in a mouth-and-throat vent passage) can be normally open to two-way flow, but again is much too flow-restrictive for present purposes even if considerably modified, say by extensive widening.

There are also inexpensive multi-layer diaphragm valves offering two-way flow under light pressure differentials while finally closing tightly against high-pressure one-way flow. In U.S. Pat. No. 7,694,701, STRUCTURE OF CHECK VALVE FOR AIR-PACKING DEVICE, Apr. 13, 2010, Koyanagi describes a unique assembly that becomes a part of plastic pressure packs—but once again the flow paths are inherently restrictive.

SUMMARY OF THE INVENTION

It is one object of the present invention, a "valved soffit vent", to prevent wind-blown rain or snow entry into a roof space, by "blowing closed" when winds press on it upwardly with a pressure differential exceeding a certain design value.

It is another object of the present invention to help protect the integrity of a roof envelope by preventing significant pressurization of the roof space, regardless of wind direction and/or the presence of non-valved vents or air leakages into such space, by blocking wind entry through the soffit vents on the windward side or sides.

It is a further object of the present invention to be usable in strongly protecting the integrity of the roof envelope by strongly depressurizing the roof space—regardless of wind direction but given that significant air leakages be sealed and non-valved vents be valved or blocked—by reducing or nullifying any net wind-induced pressure pushing outward on the envelope.

It is a still further object of the present invention to stay quiet even in gusty wind conditions.

It is a basic object of the present invention to provide ventilation by remaining open in most weather conditions to allow in-out airflow. An attendant object is to minimize the size and number of vents needed for proper ventilation by having each valved vent present a "net free area" close to the size of the vent's plan area.

Terms: For greater certainty, some terms used herein are defined as follows: "Roof" refers to an entire roof structure of a house or house-like building having an overhang around most or all of the building's perimeter walls. "Roof space" refers to the space enveloped by roof sheathing above and ceiling and soffits below (and often by gables and dormers too), whether the space is just several inches deep or rises to several feet—where it's commonly called an "attic". ("Roof space envelope" refers to the enclosing sheathing, soffits, gables . . . ) "Soffit vent" refers inclusively to a rectangular opening through a soffit along with a protective grille (often having an insect screen affixed over it) typically applied to the underside of the soffit to cover that rectangular opening. "Net free area" refers to the total opening available for airflow downward and upward through the soffit vent wherein areas blocked by materially whole parts of the grille and insect screen are subtracted from the total area described by the sides of the rectangular aperture. (The "net free area" is typically about 70%-80%, such high proportions being achieved to reduce the size and/or number of soffit vents required for roof space/attic ventilation.) "Accordion-fold" refers to a hill-and-valley configuration describable as inverted repeated Vs (VVVVVV, but inverted).

Briefly described, the invention is a valved airflow control apparatus affixed over a soffit vent, the apparatus having the combination of a housing and a valve, the housing comprising a shallow-walled rectilinear box having a top piece but no bottom, the top piece including a plurality of hills and valleys having sloped sides wherein half the sloped sides are materially whole while opposing sloped sides are largely open, having apertures offering a net free area for airflow passage through the top piece about equal to the net free area of the soffit vent itself, the apertures arranged so that no aperture directly faces a neighboring aperture; and the valve having an essentially identical pattern of hills and valleys as the housing's top piece but with apertures that are in a pattern that is reversed to the apertures of the housing; whereby the valve rests within the housing and sufficiently below the housing's top piece so that all apertures allow air to flow freely downward and upward through the soffit vent unless sufficiently upward-acting wind pressure lifts the valve upward against the housing's top piece, whereby the materially whole sloped sides of the valve close over the apertures of the housing and the materially whole sloped sides of the housing close over the apertures of the valve, the closure blocking wind and rain entry into the roof space; while at the same time those soffit vents located around the wind-depressurized lee sides of the house, being similarly covered with the valved apparatus, remain open so that the roof space is connected only to the lee side air and is itself depressurized, reducing net outward acting air pressures trying to force apart the roof space envelope.

These features, aspects, and advantages of the invention will become better understood when the following detailed description is read with reference to the accompanying drawings, in which like characters represent like or similar parts throughout.

DETAILED DESCRIPTION OF THE PREFERRED EMBODIMENTS

Figure 1:
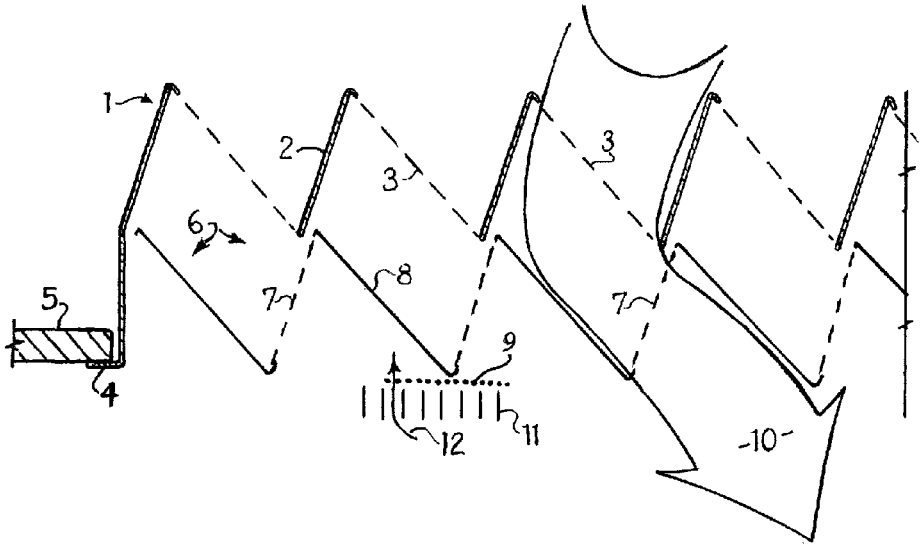
FIG. 1 is an elevational cross-section of a portion of an "accordion-fold" form of a valved vent, according to the invention, in which a fixed part is above a movable part, respectively the "housing" and the "valve", shown here in the valved vent's "at rest" open stance.

FIG. 1 illustrates an "accordion fold" embodiment of the present invention, in which just two parts comprise essentially the whole device, one a fixed part and one a movable part. 1 denotes the fixed part, the "housing", the top of which incorporates hills with sloped sides 2 facing one way being materially whole and sloped sides facing the other way being largely open, having apertures shown by dashed lines 3. The housing 1 is affixed by a flange 4 to a soffit 5, in this example, so as to completely span a cut-out vent opening in the soffit. The second part, 6, the valve, is shown here in its open state, resting within the housing 1. The valve 6 incorporates its own hills having apertures 7 and materially whole sloped sides 8, essentially equal in size and shape and positioned more or less vertically under, respectively, the materially whole sloped sides 2 and apertures 3 of the housing 1.

The valve 6 may be supported in the illustrated open position by an insect screen 9, incorporated into the fixed housing 1 or (as commonly done in such ventilation openings) into a grille which is affixed under the soffit to protect the valved vents opening. The accordion-folded configuration of the materially whole sides 2 and 8 and their respectively adjacent apertures 3 and 7 allows the apertures' total area to be about that of the full ventilation opening. The valved vent thereby offers almost "free-flow" ventilation in its open stance.

This free-flow advantage configuration is important not only for normal ventilation reasons (where inward and outward air movements are pushed by rather slight pressure differentials due to breezes or just thermal convection) but for the hurricane protection reasons noted earlier. Sudden outdoor depressurizations caused by hurricane gusts will "pull" an outward burst of air, as indicated by the arrow 10 for just one example path. Ample openness allows the roof space pressure to drop quickly to about the lowest pressures outboard of the valved vent—given of course that those valved vents facing net inward pressures close quickly. The roof space depressurization reduces or even nullifies net outward pressures, helping keep the roof space envelope intact.

The valved vents' ability to quickly block inward flow is indeed even more important than their provision of free outward flow. Blocking ruinous rain entry is perhaps their most important function. Further, hurricane winds hitting broadside on some common vented roof configurations can cause roof space pressurization, adding significantly to the outward acting forces, but the valved soffit vents prevent that in practically any roof—even when air leaks and roof-top vents are left as is.

The grille 11 helps direct inward-sweeping air 12 upward. As discussed below, if the valve's design is balanced so that net pressures on it are straight upward, then it can close quickly without any jamming tendency.

Figure 2A:
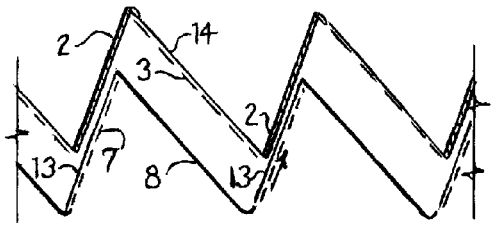
FIG. 2*a* is an elevational cross-section of a portion of the housing and valve in which the valve is being blown closed against the housing.

FIG. 2*a* illustrates such an ideal closing in progress. Slim frames 13 can be beneficially fitted across the valve's apertures 7, moving in sliding contact against the lower edges of the sloped sides 2, and so helping guide the rising valve 6 to its final nested position. The slim frames 13 also help stiffen the whole valve 6 to act as a stable accordion-folded plate despite its thin, light construction. (Of course, the valve 6 could be further stiffened by very light beams spanning under its valleys, or by side flanges or other such means, not shown.) Very similarly (and as will be illustrated more clearly in FIG. 3), slim frames 14 span across the housing's apertures 3; acting primarily as beams which help support the valve's materially whole sloped sides 8 against wind pressures in their closed position, allowing the valve 6 to be thin and lightweight and yet structurally adequate; and also helping guide the valve's upward movement.

Figure 2B:
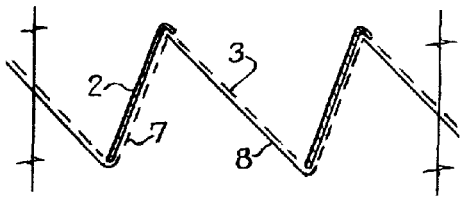
FIG. 2*b* is an elevational cross-section of a portion of the housing and valve in which the valve has been blown closed against the housing.

In FIG. 2*b* the valve is shown closed against the housing, with its sides 8 covering the housing's apertures 3 and the housing's materially whole sloped sides 2 covering the valve's apertures 7.

Figure 3:
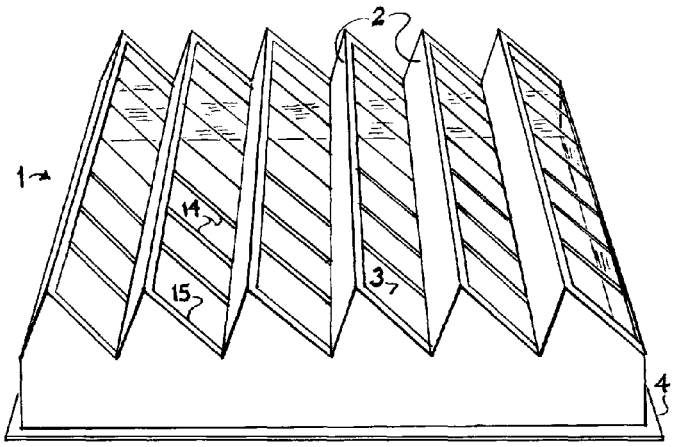
FIG. 3 is a perspective sketch of the accordion fold type of housing, as viewed from above.

In FIG. 3, the housing 1 is shown by itself (valve 6 removed). As noted above, the thin, slim frames 14 span the housing's apertures 3, so that they (together with the edge support provided by the sloped materially whole sides 2) allow the valve's materially whole sloped sides 8 (valve not shown) to be thin and light and yet bear hurricane force wind pressures. The slim frames 14 could take the form of a grille or even an insect screen.

The valve's materially whole sloped sides 8 (not shown) can not snugly close the apertures 3 at the sides' ends but must leave small gaps there, since free movement of the valve 6 requires a loose fit. Therefore flanges or "sidebars" 15 may be beneficially provided in the housing 1 to help cover such gaps and also further support the sloped materially whole sides 8 against upward-acting air pressures in their closed position up against the housing 1.

The whole valved vent assembly could be comprised of just two pieces (not counting the soffit vent itself, with its insect screen, grille and fasteners), the housing 1 being of relatively thick thermoplastic composition and the valve 6 being similarly constituted but suitably thin and light, both parts being one-piece injection molded or possibly stamped or even thermoformed. The materially whole could well be polypropylene, but where fire safety aspects are thought relevant a self-extinguishing polycarbonate, PVC or ABS could be used, for example. These would offer complete corrosion resistance for near-coastal areas such as along practically the whole hurricane belt (whereas common aluminums would not likely satisfy the anti-corrosion requirements, nor galvanized steel the valve lightness requirement).

Unfortunately, this early design of FIGS. 1-3 is far from ideally "balanced": all the valve's materially whole sloped sides face one way, so that inward air pressure pushes not only upward but against those sides toward one end. Wind tunnel and similar testing now show that the tendency to "jam" the valve against one end and the aperture side of the housing's hills is strong: friction can prevent complete closure of valve against the housing. (As shown, this initial design does try to avoid jamming by sloping the valve apertures and matching housing materially whole sloped sides closer to vertical. That itself does not work reliably, however, and the less-sloped sides do restrict aperture area.) Jamming could be controlled with hinged radius arms or low-friction vertical dowels, for example, but any such gear could complicate manufacture and handling.

Figure 4:
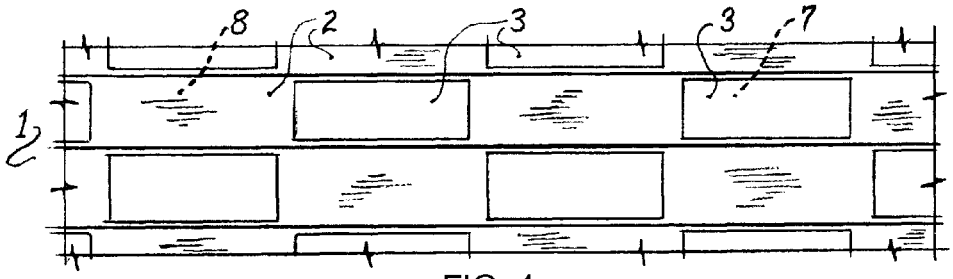
FIG. 4 is a plan view of a portion of an accordion-fold valved vent, a hill with its side slopes, wherein apertures and materially whole segments alternate and half face one way and half the opposite.

Accordingly, FIG. 4 presents a further embodiment of the accordion-folded design, according to the invention, using simple 2-way balancing to nullify net lateral force on the wind-lifted valve. Here, looking down on one hill of the housing 1, showing small amounts of the adjoining valleys as well, it can be seen that all sloped sides in the housing are comprised of materially whole segments 2 alternating with apertures 3, staggered so that half the apertures face one direction and half the other and no aperture directly faces another. Underneath, the valve's materially whole segments 8 and apertures 7 are indicated by dashed lines, these being offset of course so that again they face equally in two directions, no aperture directly faces another, and valve closure up against the housing completely closes the vent.

Testing shows that accordion-fold valved vents, even if balanced, can still be a little balky in response: the ends of the valve hills are closed by small vertical walls, all fitting fairly snugly within the housing's vertical sidewalls, so that any side-to-side rocking of the vent can cause some jamming friction which can interfere with falling open and/or completely closing. The next two embodiments stay clear of this and all such drawbacks.

Figure 5A:
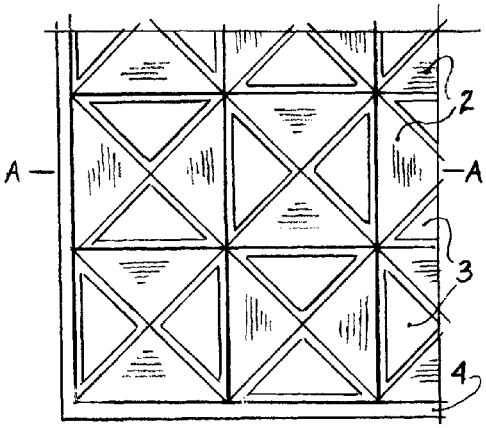
FIG. 5*a* is a plan view of a corner portion of the housing of a balanced multi-pyramidal form of valved vent, wherein an equal area of apertures face in each of four directions.
Figure 5C:
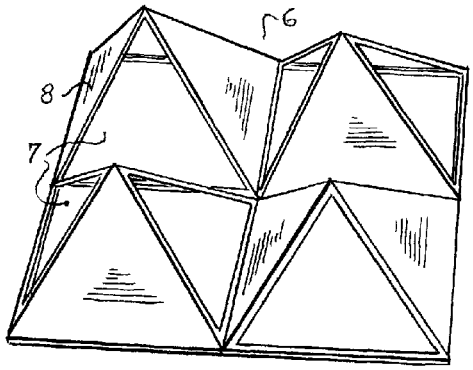
FIG. 5*c* is a perspective sketch of a 4-pyramid portion of the multi-pyramidal vent itself, as viewed from above.
Figure 5B:
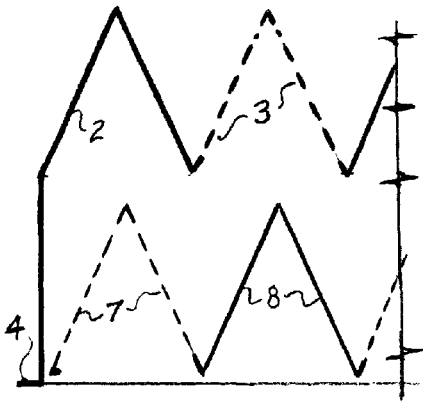
FIG. 5*b* is an elevational cross section through A-A of FIG. 5*a* of the portion of the multi-pyramidal valved vent.

In FIG. 5, a "multi-pyramidal" configuration of the invention, each and every pyramid offers a open area, two opposing sides being apertures 3 and 7 and the other two being materially whole sides 2 and 8, in housing and valve respectively. Incoming air presses not just upwardly but strongly laterally on the valve's pyramid sides 8, but equally in all four directions: the valve is not pushed laterally. (A single 4-pyramid "module" as illustrated in FIG. 5*c* would undergo a rotational torque in the horizontal plane, but a valve is composed of several of these—say six, two wide and three long—so exhibiting no significant torque.) And the valve has no vertical side walls; slight rocking cannot cause jamming. A 4-pyramid test mock-up, as in FIG. 5*c* but complete with housing of course, proved satisfactory, closing and opening fairly responsively and reliably. (That mock-up measures about 122×122 mm in plan, less than 5"×5", so that a two-wide by three-long valved vent would install in a 10"×14.4" vent opening, as a usable example design.)

Figure 6A:
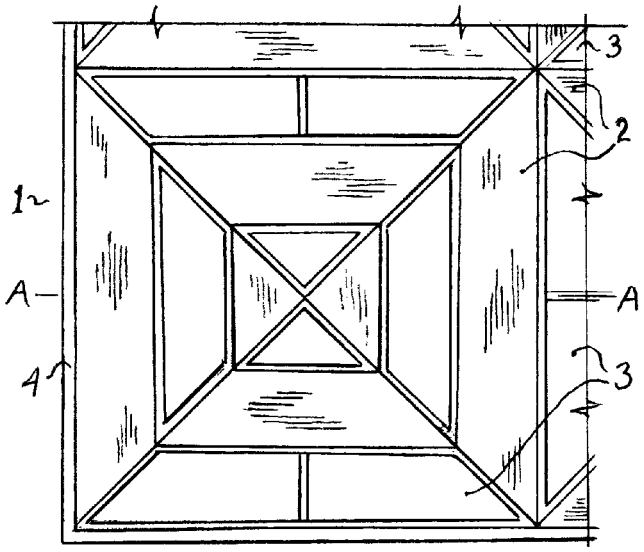
FIG. 6*a* is a plan view of a portion of the housing of a "four-way hills" form of valved vent, wherein an equal area of apertures face in each of four directions.
Figure 6C:
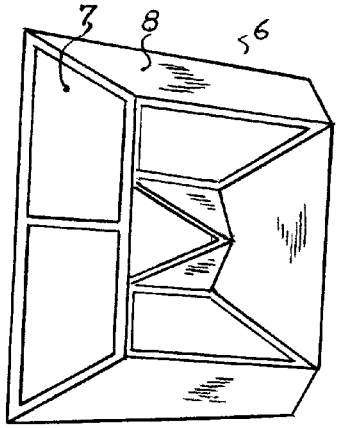
FIG. 6*c* is a perspective sketch of a portion of the four-way hills vent itself, as viewed from above.
Figure 6B:
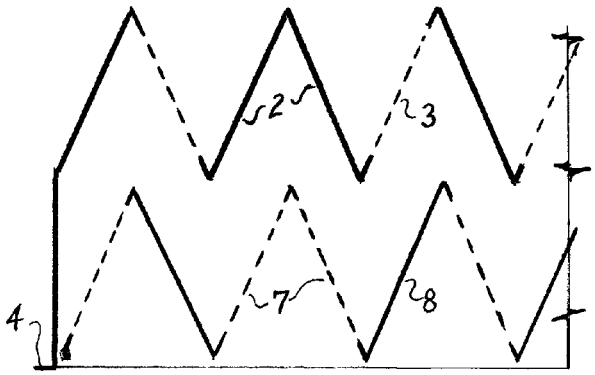
FIG. 6*b* is an elevational cross section through A-A of FIG. 6*a* of the portion of the four-way hills valved vent.

FIG. 6 presents a "four-way hills" valved vent, clearly a preferred embodiment of the invention. It offers full openness, four-way balance and essentially no side walls on the vent, with little to question about manufacturing, precision, strength or handling (e.g., it allows "nesting" for compact shipping). A 4-hill test mock-up (as shown in FIG. 6*c* but complete with housing) performs perfectly in wind testing.

While not crucial, the very openness of these valve designs does not encourage responsive closure: air can pass through very easily and so exert little lift. Therefore a further option (not shown), is to attach the insect screen 9 itself across the bottom of the valve—not to the grille or the soffit opening as typically done—so that the screen's resistance to airflow adds to the lift on the valve. Today's insect screens for soffit vents are light in weight and testing shows their incorporation with the valve can add appreciably to valve lift. Again, such incorporation is not crucial but there may be advantages.

(Somewhat contrary to that idea, however: why not corrugate the insect screen 9 itself—the one remaining "choke"—to open it up further as well? Then perhaps it could even be made strong enough in its corrugated form to replace the usual grille, affixed across the housing, in a removable/replaceable way in case of damage. Not shown.)

While this invention has been described and detailed with respect to certain tested embodiments thereof, it will be appreciated and understood by those skilled in the art that various changes in form and detail thereof may be made without departing from the spirit of the claimed invention. The rectilinear form could instead be circular or oval, for example, with the hills and valleys or like convolutions formed in concentric circles. While certain patterns of hills and valleys and apertures therein are separately claimed, there are advantages in combining one pattern with another in one apparatus to gain more openness and perhaps other advantages. And although the invention has been shown in an immediately needed usage as a horizontally disposed valved vent, particularly a valved soffit vent, it must be appreciated that other configurations and orientations can follow the same concept of "hang open unless blown shut". A common gable vent could be similarly and beneficially controlled, with the valved vent disposed off-vertically and with the valve's weight keeping it normally open, or with a weighted lever, say, disposed to the same effect. Or, the invention could be arranged more or less upside down, for example, where desired to "lie shut until blown open", like a common vent cap, and still provide relative quietness and unimpeded flow (one-way, in this instance), and cost advantages too. And the concept could be employed in controlling other gas or fluid flows, not just air.

We claim:

1. An airflow control apparatus for a soffit vent, comprising:

a housing adapted to be mounted over the soffit vent, the housing being a shallow-walled rectilinear box having a top piece but no bottom, the top piece including a plurality of hills and valleys having sloped sides, wherein half the sloped sides are materially whole while opposing sloped sides include apertures offering a net free area for airflow passage through the top piece about equal to the net free area of the soffit vent itself, the apertures arranged so that no aperture directly faces a neighboring aperture;

a valve having an essentially identical pattern of hills and valleys as the housing's top piece, with apertures that are in a pattern that is reversed to the apertures of the housing, and wherein half the sloped sides are materially whole;

whereby the valve rests within the housing and sufficiently below the housing's top piece so that the apertures allow air to flow freely downward and upward through the soffit vent unless sufficiently upward-acting wind pressure lifts the valve upward against the housing's top piece, whereby the materially whole sloped sides of the valve close over the apertures of the housing and the materially whole sloped sides of the housing close over the apertures of the valve, the closure blocking wind and rain entry into the roof space; when the airflow control apparatus is located on a wind-depressurized lee side of a structure, the apertures remain open so that the roof space is connected only to lee side air and is itself depressurized, reducing net outward acting air pressure from forcing apart the roof space envelope.

2. An airflow control apparatus according to claim 1, wherein the plurality of hills and valley's of the housing's top piece and the valve below are formed in accordion-fold fashion, and have all apertures in the housing's top piece facing in one direction and all apertures in the valve facing in the opposite direction;

the design of the housing's sidewalls and/or the provision of vertical guide pins or hinged arms is such that the valve's movement upward and downward is guided vertically to help prevent jamming of the valve against the housing, despite the fact that upward air pressure acts against the valve's sloped materially whole sides to push the valve not only upward but horizontally in one direction.

3. An airflow control apparatus according to claim 1, wherein the plurality of hills and valley's of the housing's top piece and the valve below are formed in accordion-fold fashion, wherein a first half of the hills and valleys in the housing's top piece have their apertures facing one way while the remaining half have their apertures facing the opposite way, while the aperture pattern is reversed in the valve below, so that apertures face equally in both ways.

4. An airflow control apparatus according to claim 1, wherein both sloped sides of all hills and valleys are comprised of materially whole segments alternating with apertures of slightly shorter lengths than the materially whole segments, with the pattern of alternation being reversed from one sloped side to the next sloped side, and the pattern reversed again between the sloped sides of the housing's top piece and those of the valve below, so that apertures face equally in both ways, no aperture directly faces another aperture, and those apertures in the valve lie directly under the housing top piece's materially closed segments of sloped sides while the valve's materially closed segments of sloped sides lie rather directly under the apertures in the housing's top piece.

5. An airflow control apparatus according to claim 1, wherein the plurality of hills and valley's of the housing's top piece and the valve below are formed as pyramids adjoining each other at their bases, each pyramid having two opposing materially whole sloped sides and its other two sloped sides as apertures, and with each adjoining pyramid rotated in plan a quarter turn so that no aperture directly faces another aperture and an equal number and area of apertures face in each of four principal directions;

the valve is almost identical in size and multi-pyramidal form as the housing's top piece except that its pyramid rotational pattern places the sloped materially whole sides of each valve pyramid directly under the aperture sides of the housing top piece's pyramid above it while the aperture sides of each the valve's pyramids lie directly under the sloped materially whole sides of the housing's top piece's pyramids, with all apertures being essentially identical in size and shape and slightly smaller than all sloped materially whole sides.

6. An airflow control apparatus according to claim 1, wherein the hills and valleys of the housing's top piece are formed as straight lengths describing squares or rectangles in plan, with a peripheral square or rectangle surrounding successively smaller ones, with each straight length of hill and valley in each square or rectangle having one sloped side materially whole and its opposing sloped side being largely apertures, and with these positions reversed in the next straight length of hill and valley in each square or rectangle, and so on, so that no aperture directly faces another aperture and the total aperture area facing a first principal direction equals the total aperture area facing the opposite way, and the total aperture area facing at right angles to that first principal direction equals the total aperture area facing the opposite way;

the hills and valleys of the valve are almost identical in size and pattern to those of the housing's top piece but the valve's materially whole sloped sides lie directly under the sloped sides of the housing top piece having apertures, while the valve's sloped sides having apertures lie directly under the materially whole sloped sides of the housing's top piece.

* * * * *